US008579552B2

(12) United States Patent
Yu

(10) Patent No.: US 8,579,552 B2
(45) Date of Patent: Nov. 12, 2013

(54) ECOLOGICAL BOARD AND ITS APPLICATIONS

(75) Inventor: Kei-Chien Yu, Kaohsiung (TW)

(73) Assignee: Kei-Chien Yu

( * ) Notice: Subject to any disclaimer, the term of this patent is extended or adjusted under 35 U.S.C. 154(b) by 58 days.

(21) Appl. No.: 13/241,213

(22) Filed: Sep. 23, 2011

(65) Prior Publication Data

US 2012/0014747 A1 Jan. 19, 2012

Related U.S. Application Data

(63) Continuation-in-part of application No. 12/202,441, filed on Sep. 2, 2008, now abandoned.

(51) Int. Cl.
*E02D 29/02* (2006.01)

(52) U.S. Cl.
USPC ..... 405/302.4; 405/15; 405/284

(58) Field of Classification Search
USPC ..... 405/15, 80, 107, 116, 284, 285, 302.4, 405/302.5, 302.6; 256/12.5, 13
See application file for complete search history.

(56) References Cited

U.S. PATENT DOCUMENTS 2,513,711 A * 7/1950 Cain ..... 47/83
4,279,535 A * 7/1981 Gagliardi et al. ..... 405/15
4,785,577 A * 11/1988 Lederbauer ..... 47/33
4,804,299 A * 2/1989 Forte et al. ..... 405/285
4,913,583 A * 4/1990 Ledeuil ..... 405/107
5,029,819 A * 7/1991 Kane ..... 256/24
5,056,961 A * 10/1991 McMeans et al. ..... 405/284
5,108,224 A * 4/1992 Cabaniss et al. ..... 256/12.5
5,131,630 A * 7/1992 Nash ..... 256/12.5
5,178,489 A * 1/1993 Suhayda ..... 405/21
5,567,089 A * 10/1996 Akamine ..... 405/285
5,580,190 A * 12/1996 Hsu ..... 405/302.6
5,741,339 A * 4/1998 DuMars et al. ..... 8/611
6,447,212 B2 * 9/2002 Orsat ..... 405/262
6,499,911 B2 * 12/2002 Hilliard et al. ..... 405/32
6,558,075 B2 * 5/2003 Benedict et al. ..... 405/21
6,579,039 B2 * 6/2003 Krenzler ..... 405/25
6,851,889 B2 * 2/2005 Buchanan ..... 405/31
7,377,726 B2 * 5/2008 Schellhorn ..... 405/284
7,736,097 B2 * 6/2010 D'Andreta et al. ..... 405/302.6
2004/0076482 A1 * 4/2004 Singleton ..... 405/302.6

* cited by examiner

*Primary Examiner* — Tara M. Pinnock

(57) ABSTRACT

An ecological board includes a quadrilateral board body, on the side edges thereof is disposed at least one reglet or at least one insertion groove to be engaged with a corresponding insertion groove or a reglet of another identical board body. Further, a plurality of separated strong and pliable pad bodies are embedded in at least a first side surface of the board body and protrude outwards therefrom. The ecological board according to the present invention is durable, stable, easy to construct, maintain, and repair, and environmentally friendly to the natural landscape. Most importantly, it can be applied to various environments, such as coastlines, artificial reefs, and slopes of reservoirs, rivers, or mountains.

7 Claims, 6 Drawing Sheets

ECOLOGICAL BOARD AND ITS APPLICATIONS

The present invention is a continuation in part (CIP) of U.S. patent Ser. No. 12/202,441, filed Sep. 2, 2008, now abandoned assigned to the inventor of the present invention, and therefore, the contents of the U.S. patent Ser. No. 12/202,441 is incorporated into the present invention as a part of the present invention.

BACKGROUND OF THE INVENTION

1. Field of the Invention

The present invention relates to an ecological board and its applications, and especially to an ecological board which is durable, stable, easy to construct and repair, and more environmentally friendly to the natural landscape.

2. Brief Description of the Related Art

Owing to limited land and rapid population growth, it is a current trend to reclaim land from the ocean. The economy status and land condition of Taiwan even make it inevitable to develop its coastline. Hence, there are land reclamation projects along coastlines in Taiwan from north to south, such as Keelung New Port (1,300 hectare), Tanhai New Town and Wastewater Treatment Plant (1,700 hectare), Bali Sand and Gravel Harbor (850 hectare), Northern Guanyin Oil Harbor (1,400 hectare) and Industrial Park (1,700 hectare), Xiangshan Tidal Flat (1,025 hectare), Changhua Xinxing Landfill Site and Changhua Coastal Industrial Park (3,643 hectare), Yunlin Offshore Industrial Park (15,680 hectare), Yunlin and Chiayi Waisanding Sand Bar Industrial Park (3,031 hectare), Chiayi Aogu Industrial Park (1,000 hectare), Beimen Township (1,000 hectare) and Qigu Township (2,800 hectare) of Tainan, Tainan Technology Industrial Park (1,000 hectare), Singda Ocean-going Fish Harbor (460.2 hectare), Kaohsiung International Airport and Deep-water Port (6,500 hectare), and Ho-Ping Cement Industrial Park in Hualien (394 hectare). The above-mentioned cases are all ambitious large-scale development projects: some are up to 6 kilometers away from the seashore, some have sea dykes extending to 30 or 40 meters below water, some have coastlines as long as 13 to 25 kilometers, and some even cover a whole county's coastline and can arguably be rated as the biggest coastline development project in the world across the century.

The foregoing land reclamation projects usually begin with building artificial structures such as breakwaters, sea dykes, and jetties along the coastlines and then fill in a large amount of rocks and sand to turn the offshore areas into land. However, to coastal landform, land reclamation is an irreversible change. It results in even stronger reflections of the ocean waves, which speedily undermine and collapse the artificial structures such as breakwaters, sea dykes, and jetties. Reconstruction after damage takes another long period of time, severely threatening the safety and property of coastal residents. The most commonly used remedy is to place a large number of armor blocks in the sea area beside the breakwaters, sea dykes, and jetties to avoid direct impact of the ocean waves. However, as soil loss at the bottom layer causes the armor blocks to sink continually, more blocks need to be added. The vicious circle leads to the disappearance of natural coastlines and damages the scenery. The road-widening project of Hualien-Taitung Coastal Highway, one of the major construction projects of the "Six-Year National Development Plan", is an example of the previously-mentioned problem. In order to widen the highway, the road width needs to be extended in the coastline direction and a new subgrade is required. A large amount of rocks and sand fills the coastline to form the new subgrade, and a lot of concrete armor blocks are placed on the beach to prevent the new subgrade from being undermined by the ocean waves. As a result, the most precious coastline in Taiwan, which extends to over 170 kilometers and is viewed as a "National Treasure", becomes an armor block embankment and the natural scenery is seriously affected. Further, the total construction cost amounts to 10.7 billion NT Dollars. Hence, constant new addition of armor blocks and breakwaters to maintain the integrity of the coastline is not only costly, demanding, and time-consuming, but their future repair and maintenance expenses could also become an unfathomably great financial burden. Moreover, they severely damage the natural scenery and cause the natural coastline to disappear. The existing land reclamation method of building breakwaters and placing armor blocks has indeed caused significant burden and damage to our economy and environment.

Similar to the disappearance of natural coastlines in offshore areas, soil loss of mountain slopes, river slopes, and reservoir slopes also share the same problem. Hence, to protect our ecology and environment, it is vital that we figure out a method of providing proper protection and adopting universally applicable set-up units which are able to attach and combine with one another to form a large area.

SUMMARY OF THE INVENTION

In order to overcome the deficiencies of the preceding prior art, an object of the present invention is to provide a product which is durable, stable, easy to construct, maintain, and repair, and more environmentally friendly to the natural landscape. Most important of all, the product is applicable to all the foregoing different environments, such as coastlines, slopes of reservoirs, rivers, or mountains.

The present invention relates to an ecological board comprising a quadrilateral board body, on the side edges thereof is disposed at least one reglet or at least one insertion groove to be engaged with a corresponding insertion groove or a reglet of another identical board body. Further, in at least a first side surface of the board body are embedded a plurality of separated strong and pliable pad bodies which protrude outwards.

Due to its special structural design, the ecological boards according to the present invention can be used along coastlines as breakwaters with their strong and pliable pad bodies hitched to stakes, which are driven to the coastline.

The ecological boards of the present invention can also be used on slopes of reservoirs and rivers as retaining walls with their strong and pliable pad bodies hitched to stakes, which are driven to the slopes of reservoirs and rivers.

The present invention provides a unit board piece which is durable, stable, easy to construct and repair, environmentally friendly to the natural landscape, and cost-effective.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
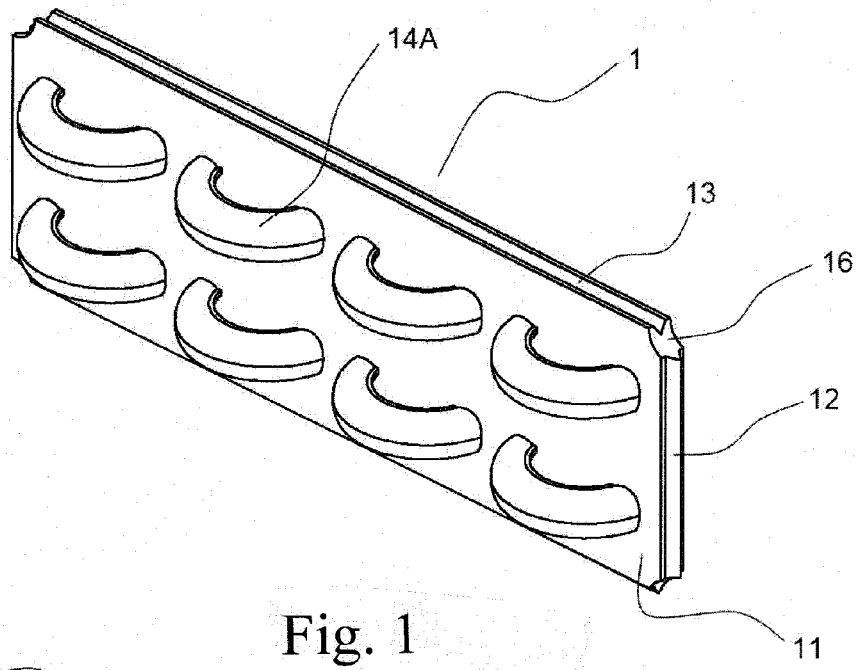
FIG. 1 is a perspective view of a single ecological board according to the present invention.
Figure 8:
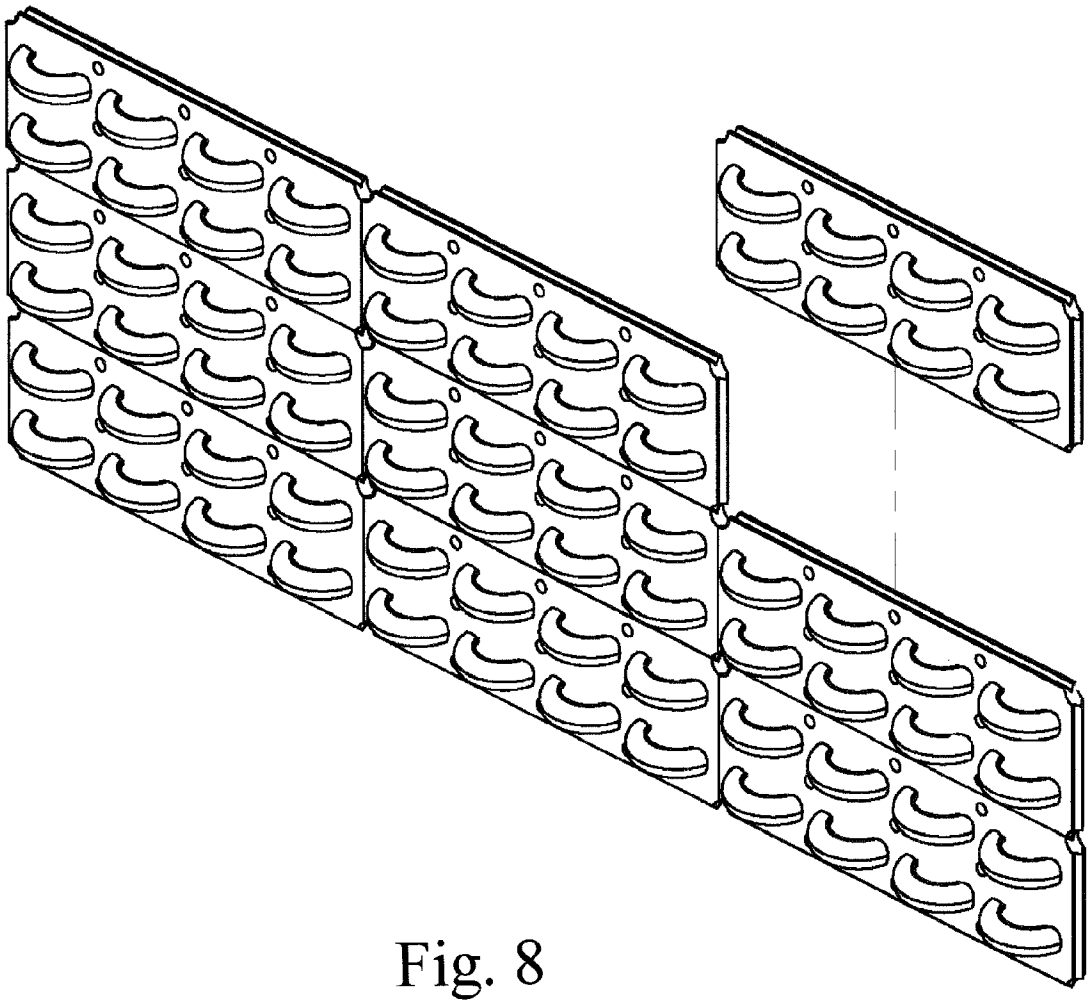
FIG. 8 is an assembled perspective view of the ecological boards according to the present invention.

Referring to FIG. 1, the present invention is related to an ecological board 1. The ecological board 1 comprises a quadrilateral board body 11. The side edges of the ecological board 1 is disposed at least one reglet 12 or at least one insertion groove 13 to be engaged with a corresponding insertion groove 13 or a reglet 12 of another identical board body 11 so that the present invention is expandable without any limitation (as illustrated in FIG. 8). Further, at least a first side surface of the board body 11 is embedded with a plurality of separated strong and pliable pad bodies 14A which protrude outwards. The strong and pliable pad bodies 14A can be made of waste tires to effectively recycle resources. The strong and pliable pad bodies 14A can effectively weaken the impact from ocean waves when placed along the coastline and can also serve as rescue climbing materials for those who stumble into the water.

The strong and pliable pad bodies 14A can grip soils effectively (the "soil" in the present invention refers to earth, stones, or the mixture of both) when used on the slopes of mountains, reservoirs, and rivers.

Figure 2:
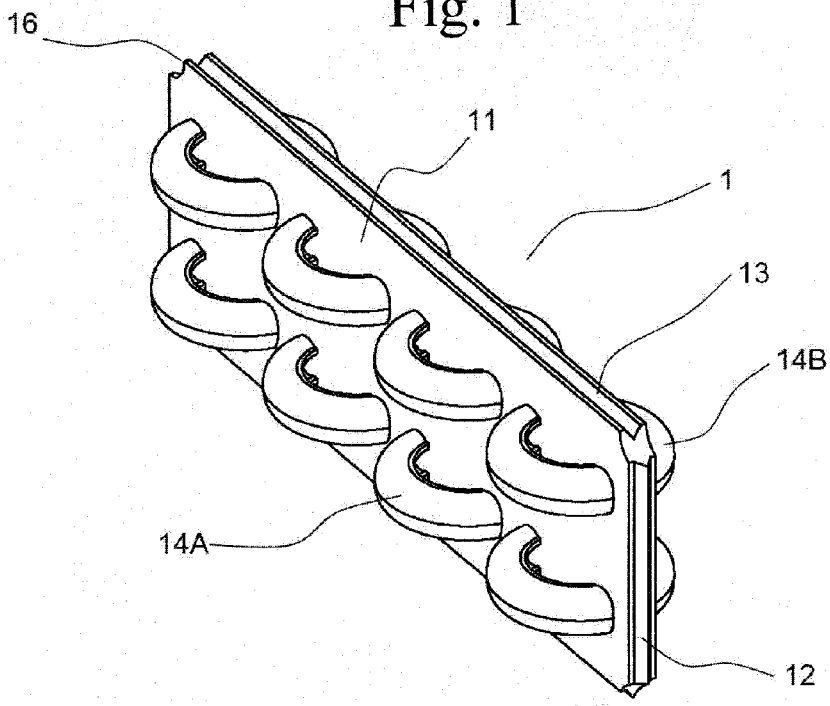
FIG. 2 is a perspective view of a single ecological board according to another preferred embodiment of the present invention.

Referring to FIG. 2, a second side surface of the board body 11 is also separately embedded with the strong and pliable pad bodies 14B. The strong and pliable pad bodies 14B protrude outwards from the second side surface of the board body 11. Further, the strong and pliable pad bodies 14B embedded in a second side surface is positioned to be corresponding to the strong and pliable pad bodies 14A embedded in a first side surface. The strong and pliable pad bodies 14B in the second side surface are disposed at slightly lower positions than those of the respective strong and pliable pad bodies 14A in the second side surface thereof, thereby forming an interlaced structure and providing a more extensive grip effect. This makes both sides usable and also provides a better grip to the soil.

Figure 3:
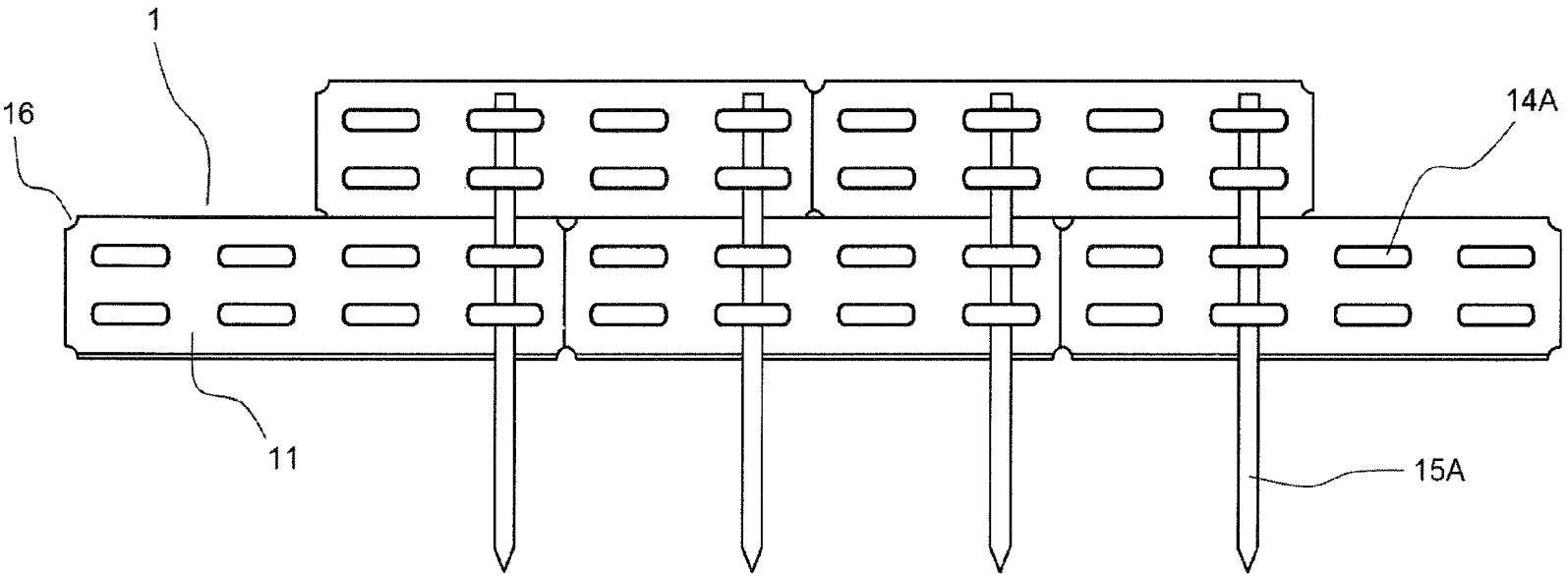
FIG. 3 is a plan view of the assembled ecological boards hitched to stakes according to the present invention.
Figure 7:
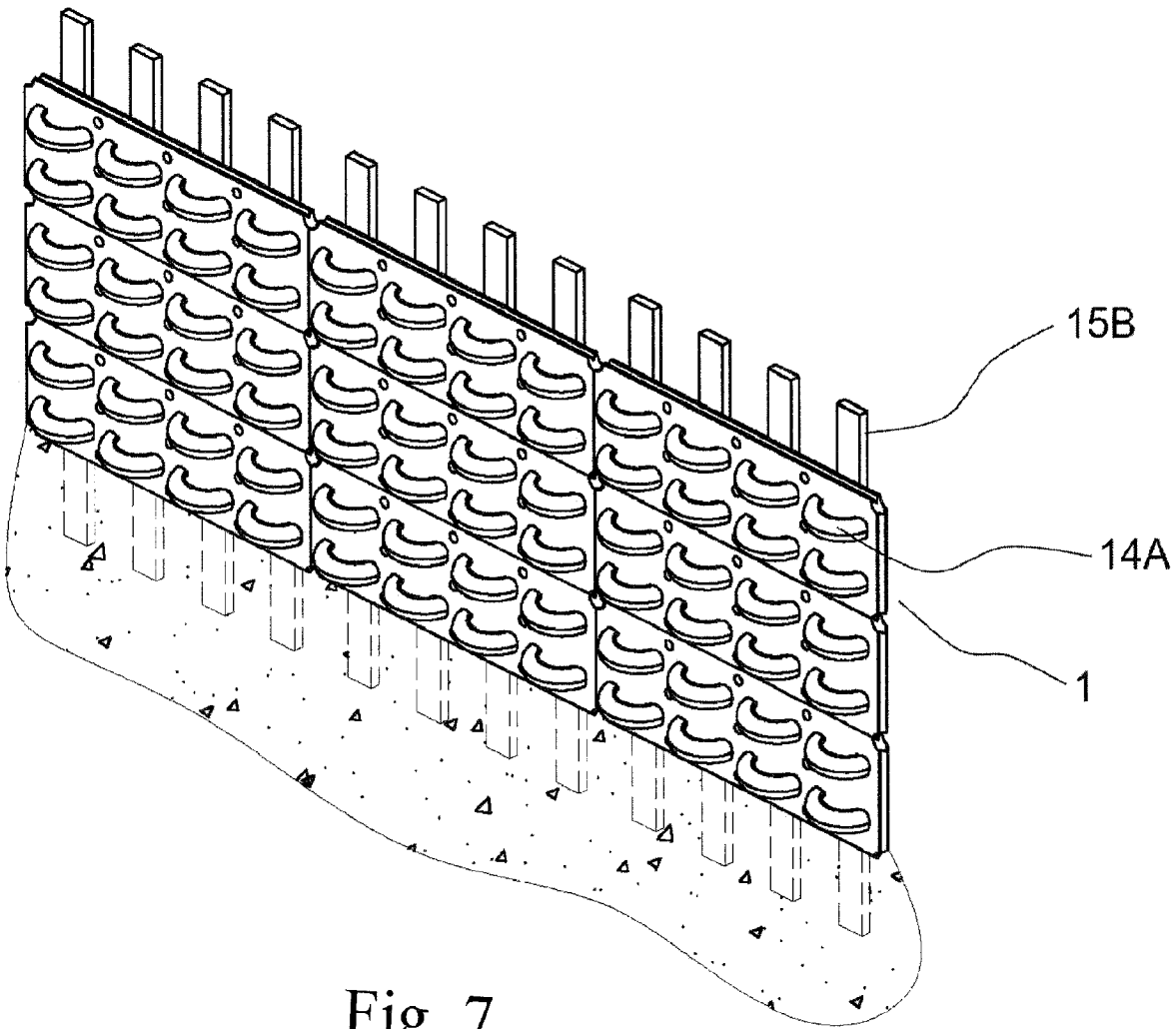
FIG. 7 is another perspective view of the assembled ecological boards hitched to stakes according to the present invention.

Referring to FIGS. 3 and 7, at least one of the strong and pliable pad bodies 14A embedded in a first side surface can be hitched to a stake 15A, and at least one of the strong and pliable pad bodies 14B embedded in a second side surface (not visible in the figures) can also be hitched to a stake 15B. The stake 15A can be made of waste utility pole to effectively recycle resources. Referring again to FIG. 1, showing the preferred embodiment according to the present invention, notches 16 are disposed on the four corners of the board body 11 to balance the osmolarity between a first and a second side surfaces.

Figure 4:
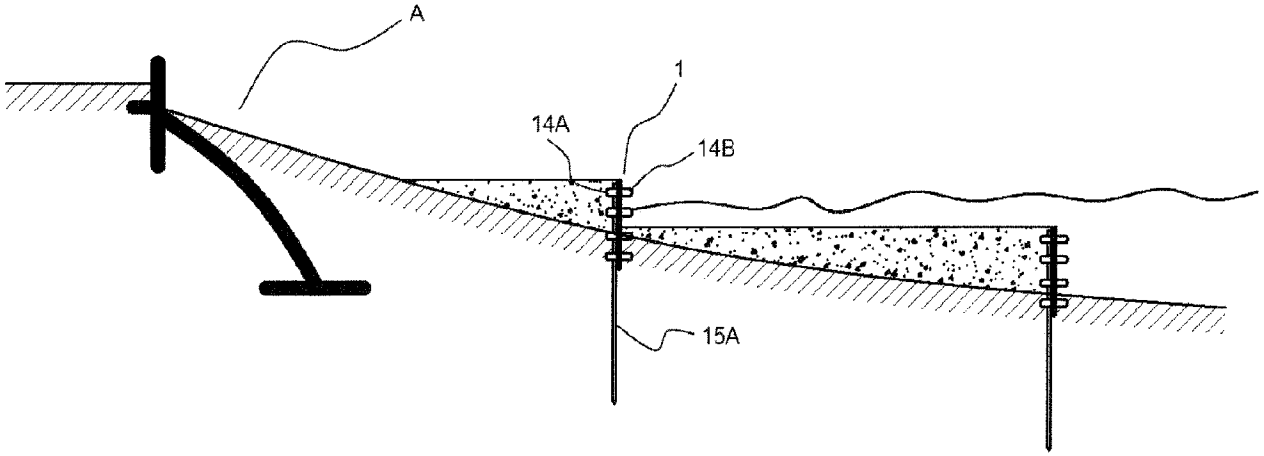
FIG. 4 is a schematic drawing of the ecological boards according to the present invention placed along coastlines.

Referring to FIG. 4, the special structural design of the ecological boards 1 according to the present invention allows them to be placed along a coastline A to serve as breakwaters with their strong and pliable pad bodies 14A hitched to stakes 15A driven to the coastline A.

Figure 5:
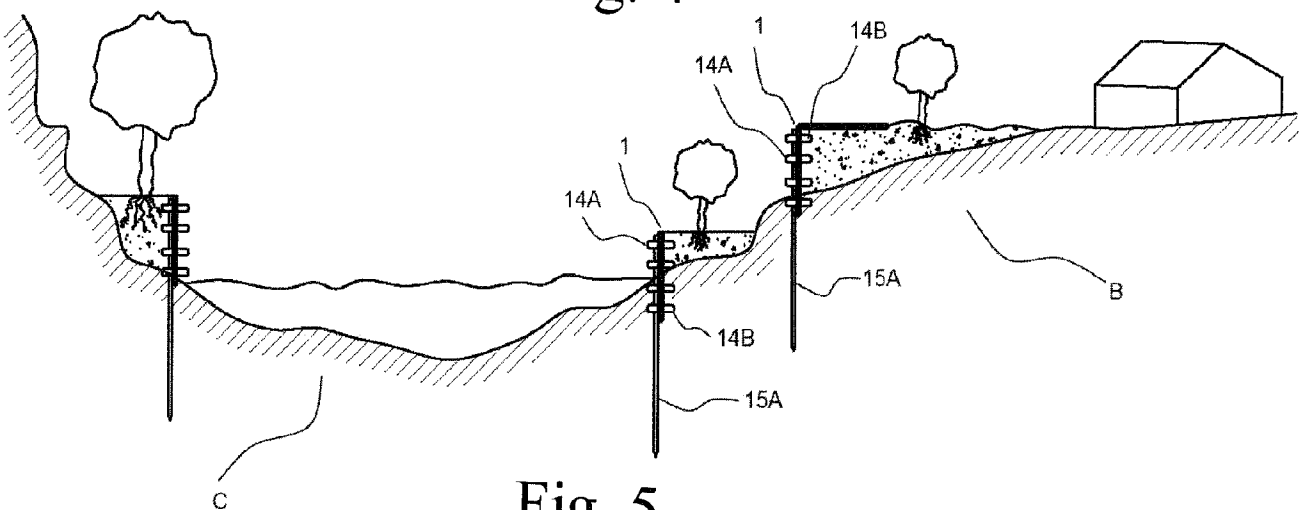
FIG. 5 is a schematic drawing of the ecological boards according to the present invention placed on the slopes of reservoirs or rivers.

Referring further to FIG. 5, the ecological boards according to the present invention can be placed on a mountain slope B to serve as a retaining wall, with their strong and pliable pad bodies 14A hitched to the stakes 15A driven to the mountain slope B.

Referring now to FIG. 5, the ecological boards according to the present invention can also be placed on a reservoir or river slope C to serve as a retaining wall to prevent siltation with their strong and pliable pad bodies 14A hitched to the stakes 15A driven to the reservoir or river slope C.

Figure 6:
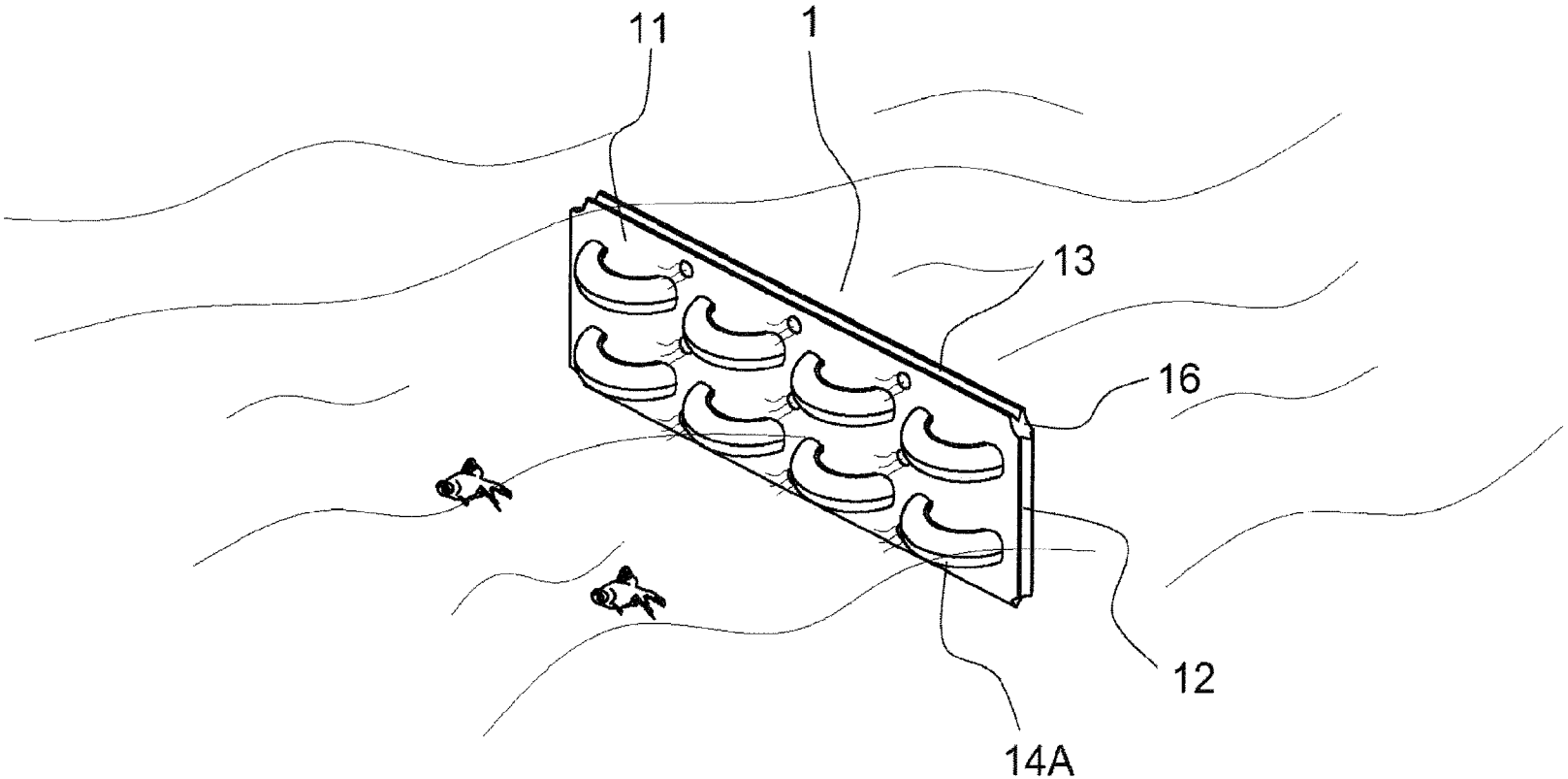
FIG. 6 is a schematic drawing of the ecological boards according to the present invention used as an artificial reef.

Referring to FIG. 6, the ecological boards according to the present invention can also serve as an artificial reef and provide a place for fish shoals to gather and help ecological development.

While the invention has been described with reference to two preferred embodiments thereof, it is to be understood that modifications or variations may be easily made without departing from the spirit of this invention, which is defined in the appended claims.

What is claimed is:

1. An ecological board, comprising:

a quadrilateral board body, the side edges thereof being disposed at least one reglet or at least one insertion groove to be engaged with a corresponding insertion groove or a reglet of another identical board body; notches being disposed on the four corners of the board body; and a plurality of separated pliable pad bodies embedded in a first side surface of the board body and protruding outwards therefrom; and wherein a plurality of separated pliable pad bodies are embedded in a second side surface of the board body and protrude outwards therefrom;

wherein the plurality of separated pliable pad bodies embedded in the second side surface thereof and protruding outwards therefrom are arranged to be correspondent to the plurality of separated pliable pad bodies embedded in the first side of the board body, with the pliable pad bodies embedded in the second side surface being disposed lower than the corresponding pliable pad bodies embedded in the first side surface, thereby forming an interlaced structure.

2. The ecological board as defined in claim 1, wherein at least one of the pliable pad bodies can be hitched to a stake.

3. The ecological board as defined in claim 2, wherein the stake is made of waste utility pole.

4. The ecological board as defined in claim 2, wherein the ecological board is used as a retaining wall on a mountain slope, wherein their pliable pad bodies hitched to stakes driven to the mountain slope.

5. The ecological board as defined in claim 2, wherein the ecological board is used as a breakwater along a coastline, wherein their pliable pad bodies hitched to stakes driven to the coastline.

6. The ecological board as defined in claim 2, wherein the ecological board is used as a retaining wall on a reservoir or river slope, wherein their pliable pad bodies hitched to stakes driven to the reservoir or river slope.

7. The ecological board as defined in claim 1, wherein the ecological board is used as an artificial reef on a river slope.

* * * * *